United States Patent [19]

Schnegg

[11] Patent Number: 4,682,480

[45] Date of Patent: Jul. 28, 1987

[54] WARP-KNIT, WEFT-INSERTED FABRIC WITH SUBSTRATE AND METHOD AND APPARATUS TO PRODUCE SAME

[75] Inventor: Julius Schnegg, Burlington, N.C.

[73] Assignee: Burlington Industries, Inc., Greensboro, N.C.

[21] Appl. No.: 784,555

[22] Filed: Oct. 4, 1985

[51] Int. Cl.[4] ..... D04B 23/08

[52] U.S. Cl. ..... 66/192; 66/143

[58] Field of Search ..... 66/84 A, 85 A, 190–194

[56] References Cited

U.S. PATENT DOCUMENTS

| | | | |
|---|---|---|---|
| 2,136,367 | 11/1938 | Amidon | 66/192 |
| 3,279,221 | 10/1986 | Gliksmann | 60/192 |
| 3,672,187 | 6/1972 | Simpson | 66/192 |
| 3,677,034 | 7/1972 | Simpson | 66/84 |
| 3,874,201 | 4/1975 | Niederer . | |
| 3,884,053 | 5/1975 | Niederer . | |
| 3,884,054 | 5/1975 | Niederer . | |
| 3,943,731 | 3/1976 | Niederer . | |
| 4,192,160 | 3/1980 | Duhl . | |
| 4,249,981 | 2/1981 | Pezletier et al. | 66/84 A X |
| 4,277,527 | 7/1981 | Duhl . | |
| 4,285,216 | 8/1981 | Duhl . | |
| 4,304,813 | 12/1981 | Elmore, Jr. . | |
| 4,399,670 | 8/1983 | Hittec et al. | 60/84 A |
| 4,425,398 | 1/1984 | Berczi | 66/193 |
| 4,435,467 | 3/1984 | Rodgers . | |
| 4,450,196 | 5/1984 | Kamat | 66/193 |
| 4,503,688 | 3/1985 | Vogel | 66/85 A |

FOREIGN PATENT DOCUMENTS

| | | | |
|---|---|---|---|
| 68316 | 8/1969 | Fed. Rep. of Germany | 66/84 A |
| 2097829 | 5/1985 | United Kingdom . | |

OTHER PUBLICATIONS

Bahlo, K. W. "New Fabrics Without Weaving" Modern Textiles Magazine, Nov. 1965, pp. 51 to 54.

*Primary Examiner*—Ronald Feldbaum
*Attorney, Agent, or Firm*—Nixon & Vanderhye

[57] ABSTRACT

A warp knit fabric comprises a substrate (preferably a non-woven fabric), plural warp yarns laid on a face of the substrate, plural weft yarns laid over the warp yarns, and plural stitch wales spaced-apart along the warp-wise direction of the fabric and being stitched through the substrate to hold the weft and warp yarns in position thereon. In such a manner, the warp yarns are interposed between the inserted weft yarns and the substrate face. A method and apparatus is also disclosed whereby the substrate and plural weft yarns are fed to a knitting area while concurrently interposing the warp yarns between a face of the substrate and the weft yarns. The weft yarns are then inserted into stitches of warp knitting yarns formed by stitching the warp knitting yarns, at the knitting ara, through the substrate so as to hold the weft-inserted yarns, and thus the interposed warp yarns, to the substrate face.

11 Claims, 6 Drawing Figures

10

48
36
26d
26c
26b
26a
30
24e
24d
24b
24a
24c
24d
24b
24a
32
22
28
46
34
42
31
44
18d
22d
22c
18c
22b
18b
22a
18a
20c
20d
20b
20a
16
12
40
38
14

Fig. 4
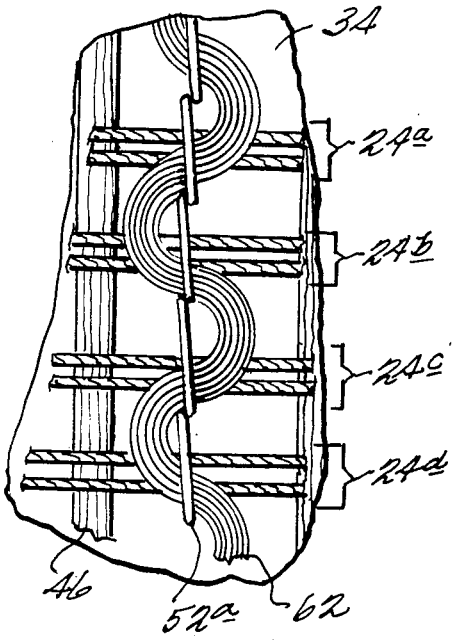
Fig. 5
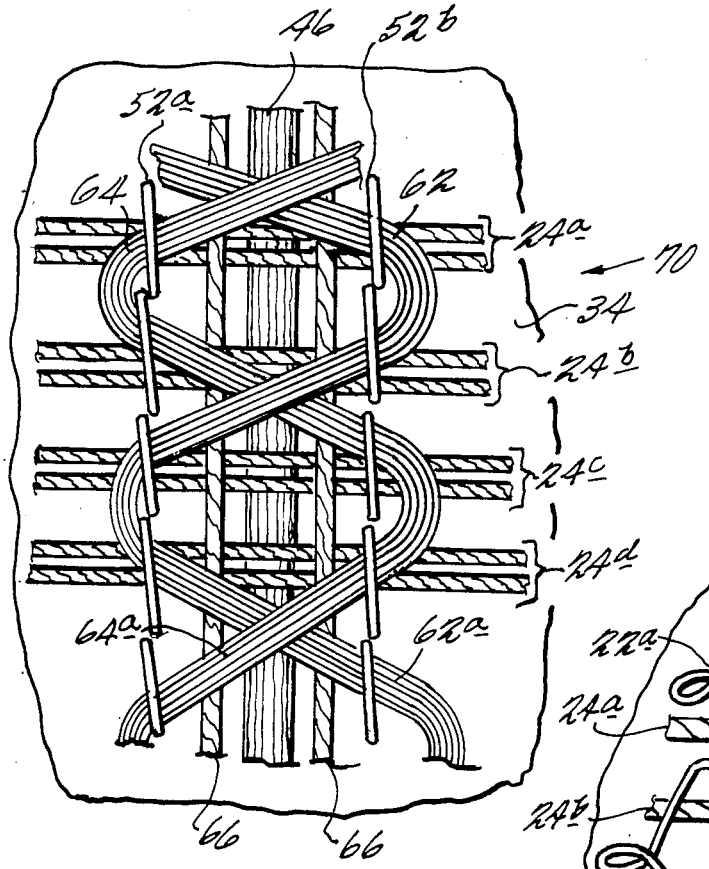
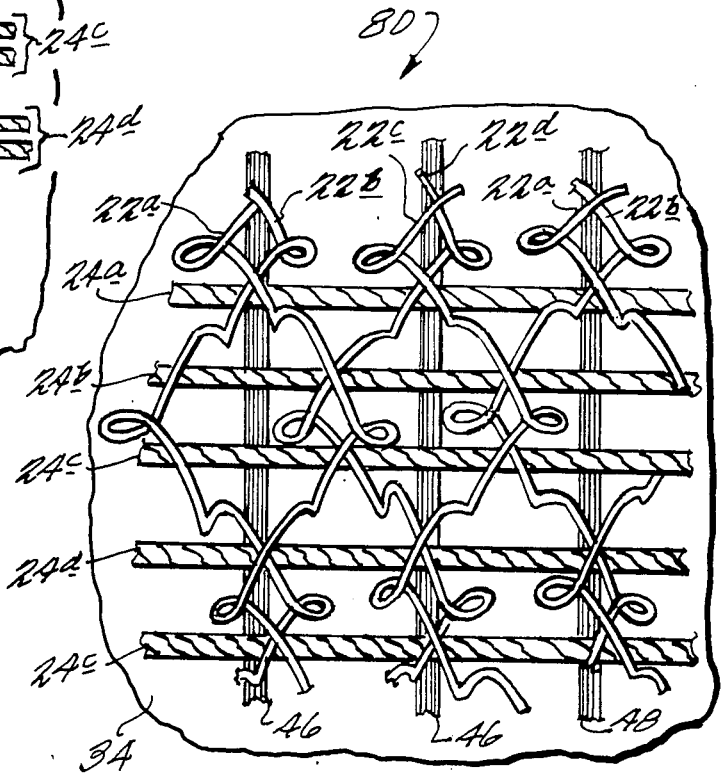
Fig. 6

WARP-KNIT, WEFT-INSERTED FABRIC WITH SUBSTRATE AND METHOD AND APPARATUS TO PRODUCE SAME

BACKGROUND AND SUMMARY OF THE INVENTION

Warp-knit, weft-insertion fabrics have achieved greater popularity in recent years with fabric designers in applications typically reserved for woven fabrics. For example, warp-knit, weft-insertion fabrics having non-woven substrates have been utilized recently as drapery fabrics.

While warp-knit, weft-insertion fabrics with a non-woven substrate have been utilized for e.g. drapery applications as a more cost effective alternative to typical woven fabrics, problems still exist which render such warp-knit, weft-insertion fabrics less desirable. For example, medium to dark fabric colors are difficult and costly to achieve since the white substrate web and backing layer is visibly perceivable through the weft fill yarns and thus the overall fabric color appears lighter than the actual color of the warp and weft yarns which are utilized. To compensate for such a disadvantage, a "tighter38 fill density (i.e. greater courses per inch) can be provided, but is a more costly solution. Moreover, weft fill yarns should be inserted into every stitch course so as to avoid an appearance of a defect in the finished fabric since the white substrate web and back coating material will again be visible.

Accordingly, what has been needed in this art is a warp-knit, weft-insertion fabric which more closely resembles a conventional woven fabric, but which alleviates the above-noted disadvantages. By way of the present invention, such a fabric is provided which alleviates the disadvantages typically associated with warp-knit, weft-insertion fabrics, but which include all of the desirable attributes of warp-knit, weft-insertion fabrics from functional and cost standpoints. The fabrics of the present invention are particularly useful as a drapery fabric but may also be used in other industrial and/or consumer applications where lower cost and dimensionally stable fabrics are desired. For example, the fabric of the present invention may find utility as a mattress ticking fabric where aesthetic appearance of the fabric may not be as important as the fabric's cost and dimensional stability.

According to one aspect of the invention, a warp-knit fabric is provided which includes a substrate (preferably a nonwoven fabric), plural warp yarns laid on a face of the substrate, plural weft-yarns laid over the warp-yarns, and plural stitch wales spaced-apart along the warp-wise direction of the fabric. The stitch wales are stitched through the substrate and are preferably formed of a plurality of chain stitches (although other stitching combinations may be utilized) such that the weft yarns are inserted into predetermined ones of the formed chain stitch courses. The stitch wales thereby hold the inserted weft yarns onto a face of the non-woven substrate and the weft-yarns, in turn, hold the warp yarns onto the face of the substrate by virtue of the interpositioning of the warp yarns between the weft-yarns and the substrate face. When the stitch wales are comprised of chain stitches, it is preferable that the warp yarns are positioned between respective adjacent pairs of the stitch wales.

The fabric of the present invention can also include one or more decorative warp yarns laid over the weft-inserted yarns such that portions of the former are captured within respective formed stitches of at least one of the stitch wales. To further enhance the aesthetic appearance and decoration provided by the decorative warp yarn, those portions thereof which are captured within respective formed stitches of at least one of the stitch wales may also be extended in a generally weft-wise direction and are thus captured in respective formed stitches of an adjacent stitch wale.

In accordance with the method and apparatus of the present invention, the substrate and plural weft-yarns are fed to a knitting area. The warp-knitting yarns are formed into stitches by stitching them at the knitting area through the substrate thereby inserting the weft-yarns into predetermined ones of the formed stitch courses. Concurrently, the warp-yarns according to this invention are fed to the knitting area such that they are interposed between the weft-inserted yarns and a face of the substrate (i.e., the technical back of the formed fabric). In such a manner, the formed stitches hold the inserted weft yarns onto the face of the substrate while the weft-yarns, in turn, hold the warp yarns onto the substrate by virtue of the latter's interpositioning between the weft yarns and the substrate face.

Further aspects and advantages of the present invention will become more clearly understood after careful consideration is given to the detailed description of the preferred exemplary embodiments thereof which follow.

BRIEF DESCRIPTION OF THE ACCOMPANYING DRAWINGS

Reference will hereinafter be made to the accompanying drawings wherein like reference numerals throughout the various figures denote like elements and wherein:

FIG. 4 is a schematic plan view of a further exemplary fabric according to the present invention, particularly showing a decorative warp yarn captured within each formed stitch loop of a warp-knitting yarn;

FIG. 5 is a schematic plan view of a further exemplary fabric according to the present invention, similar to the fabric of FIG. 4, except that the decorative warp yarns are extended generally in the weft-wise direction so as to be captured within stitch loops of an adjacent pair of stitch wales; and FIG. 6 is a schematic plan view of a further exemplary fabric according to the present invention showing an alternative stitch construction of the warp-knitting yarn.

DETAILED DESCRIPTION OF THE PREFERRED EXEMPLARY EMBODIMENTS

Figure 1:
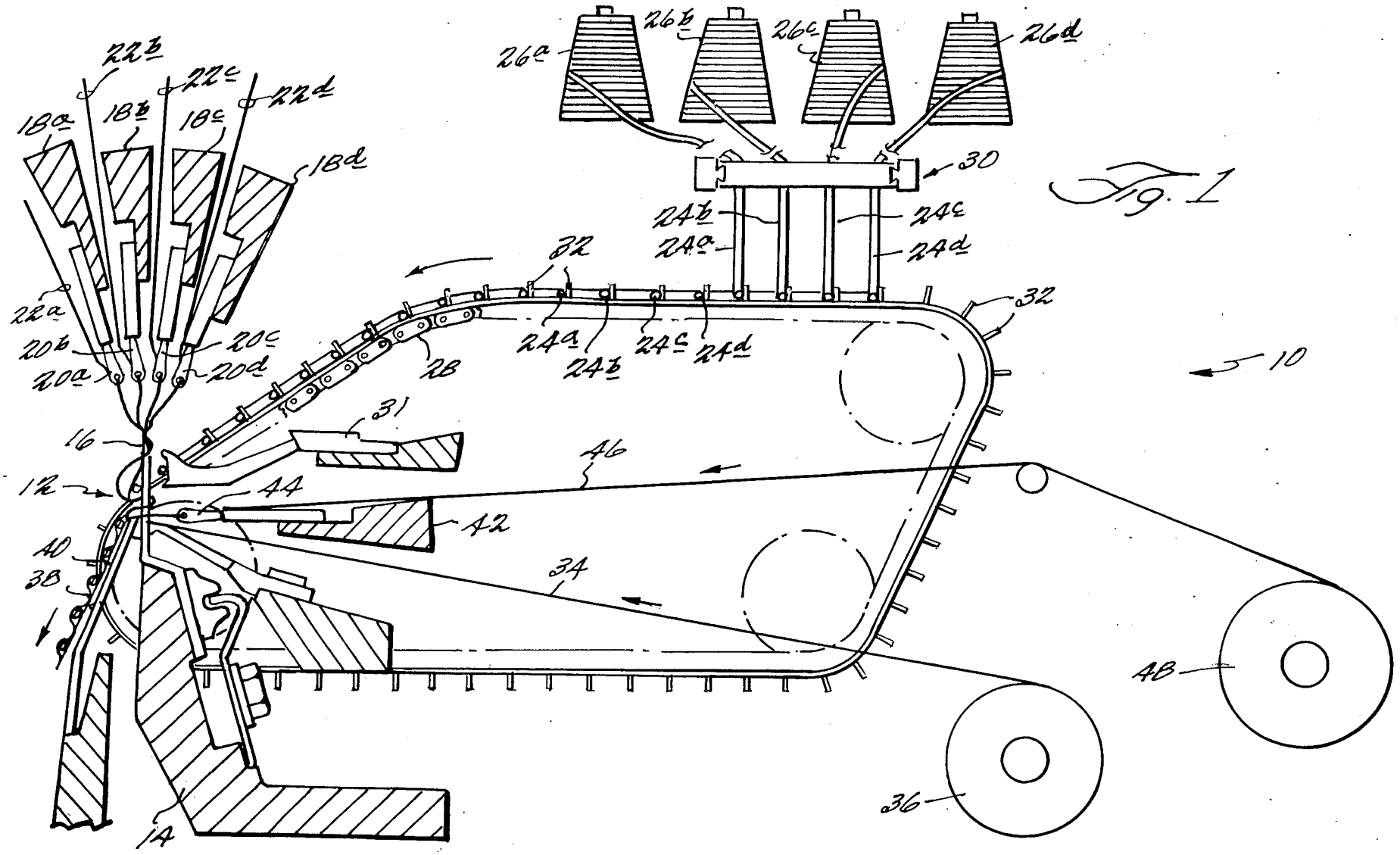
FIG. 1 is a schematic elevation view of a warp-knitting weft-insertion machine of the present invention.

Referring specifically to FIG. 1, a warp-knitting machine 10 of a well known character is exemplified as including the modifications in accordance with the present invention. The warp-knitting machine 10 depicted in FIG. 1 generally shows the component parts of a Mayer Textile type RS4 MSU warp-knitting machine having been modified in accordance with the present invention as will be discussed in greater detail below. Other warp-knitting machines can be similarly modified, however, in accordance with the present invention and thus, the invention should not be considered as being limited to the apparatus 10 schematically shown in FIG. 1. For example, other rashel and tricot weft-insertion warp knitting machines such as Liba, Mayer, as well stitch bonding machines, such as Malimo machines, can be advantageously modified in accordance with the present invention.

As is conventional, apparatus 10 includes a knitting area 12 comprising a reciprocally movable needle bar 14 carrying a plurality of stitch needles 16 which cooperate with guide bars 18*a*–18*d* respectively carrying yarn guides 20*a*–20*d*. (Only one of the stitch needles 16 and one of each yarn guides 20*a*–20*d* is shown in FIG. 1 for purposes of clarity.) As is well known, needle bar 14 reciprocates in the vertical direction (as viewed in FIG. 1) to form the warp-knitting yarns 22*a*–22*d* being guided by guide bars 18*a*–18*d*, respectively, into stitches at the knitting area 12. As is well known, the guide bars 18*a*–18*d* are shoggable in the cross-machine direction by suitable cam means (not shown) so as to cooperatively form, with respective needles 16, the desired stitches in the warp-wise direction.

Weft yarns 24*a*–24*d* to be inserted within the formed stitches at knitting area 12 are fed from respective yarn cones 26*a*–26*d* and disposed upon weft carrier chain 28 by means of transversely-movable carriage 30. That is, carriage 30 traverses in the cross-machine direction (i.e. out of the plane of FIG. 1) so as to extend the weft yarns 24*a*–24*d* in the cross-machine direction. The position of the weft yarns 24*a*–24*d* is maintained upon carrier chain 28 by means of upstanding pins 32. Upon reaching the knitting area 12, the weft yarns 24*a*–24*d* are sequentially pushed, via reciprocating pusher bar 31, into the stitch loop being formed by means of the cooperating guide bars 18*a*–18*d* and stitch needles 16 thereby capturing the weft yarns in the resulting formed chain stitch.

A substrate 34 is also conveyed from substrate beam 36 concurrently with the formation of the chain stitches and the insertion of the weft yarns 24*a*–24*d* at knitting area 12. As can be appreciated by those in this art, the stitch needles 16 penetrate the substrate 34 at the knitting area 12 during formation of the chain stitches which capture the weft-insert yarns so that the resulting warp-knit weft-inserted fabric 38 exits from knitting area 12 via trick plate 40.

In accordance with the present invention, a warp yarn guide bar 42 carrying a plurality of yarn guides 44 positioned in the cross-machine direction (only one yarn guide 44 being shown in FIG. 1 for clarity of presentation) is positioned upstream of the knitting area 12 and is operatively disposed between the conveyance path of the weft-yarns 24*a*–24*d* (established by means of carrier chain 28) and the conveyance path of substrate 34. The guide bar 42 is preferably stationary (i.e. immovable) but could be shoggable according to cam means (not shown) similar to those employed for transverse movement of guide bars 18*a*–18*d*. Each guide bar 42 therefore guides respective warp yarns 46 from warp yarn beam 48 and, due the positioning of yarn guide 44 between the conveyance paths of weft yarns 24*a*–24*d* on the one hand and substrate 34 on the other hand, the warp yarns 46 are interposed between the weft yarns 24*a*–24*d* and substrate 34.

Figure 2:
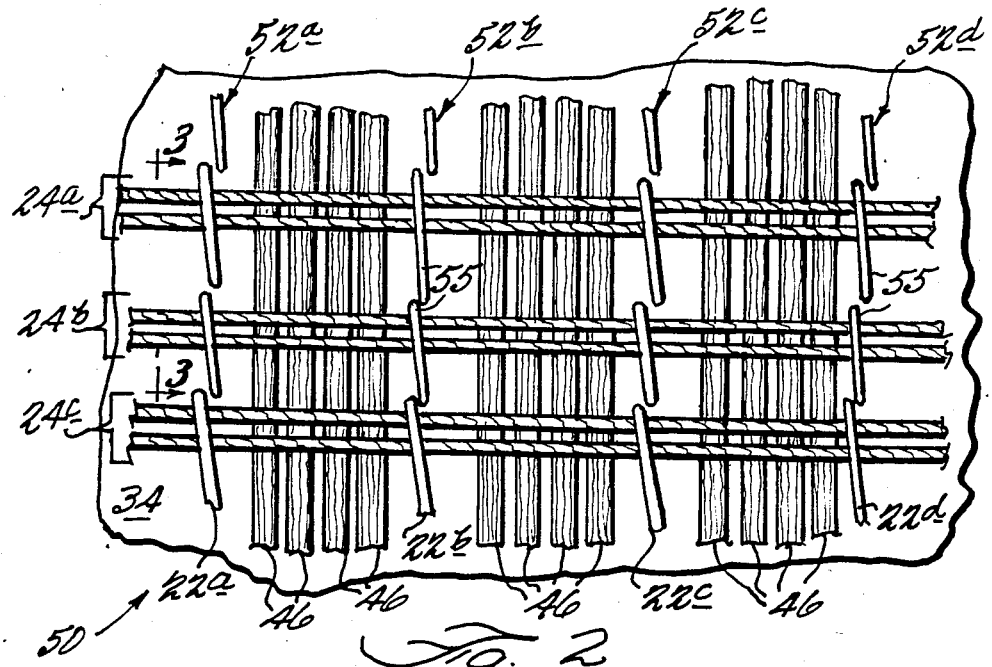
FIG. 2 is a schematic plan view of an exemplary fabric according to the invention showing the warp yarns interposed between the weft-inserted yarns and a substrate.
Figure 3:
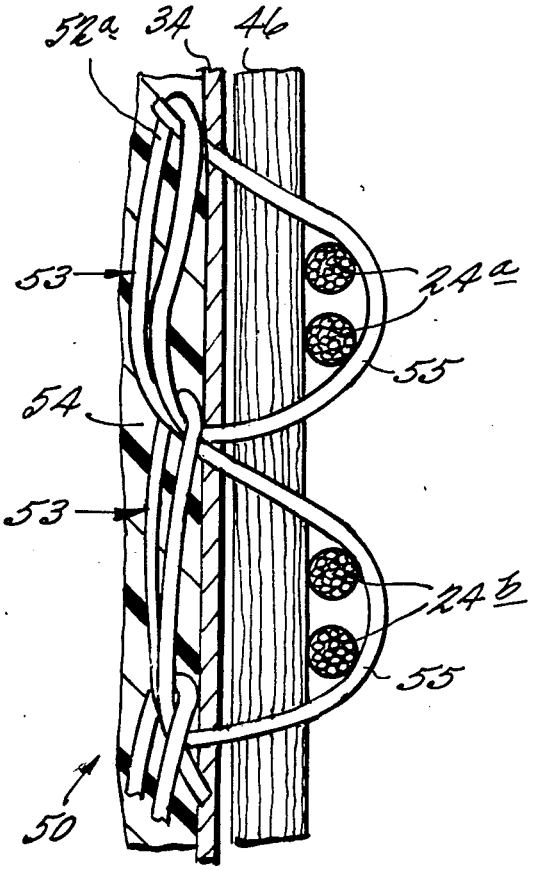
FIG. 3 is a schematic cross-sectional elevation view of the exemplary fabric of this invention shown in FIG. 2 taken along line 3—3 therein.

An exemplary fabric 50 in accordance with the present invention is shown in accompanying FIGS. 2 and 3. As can be seen, fabric 50 includes the warp knitting yarns 22*a*–22*d* which have been formed into respective chain stitch wales 52*a*–52*d*. Stitch loops 53 are on the technical face side of the substrate 34, while stitch underlap 55 are over the wrap and weft yarns 46 and 24*a*, 24*b*, respectively. The warp knitting yarns 22*a*–22*d* illustrated in FIG. 2 are stitch underlap 55. The weft yarns 24*a*–24*c* (yarn 24*d* not being visible in FIG. 2) are thus inserted into the chain stitch courses of stitch wales 52*a*–52*d* while warp yarns 46 are interposed between the inserted weft yarns 24*a*–24*c* and the substrate 34. The completed fabric 50 preferably includes a coating layer 54 of a 100% acrylic foam material with suitable flocking agents on the technical front side of the fabric 50 as can be seen more clearly by reference to FIG. 3. The weft-insert yarns 24*a*–24*c* are shown in FIGS. 2 and 3 as being two-ply (i.e. two individual yarns) but could be single-ply, three-ply, four-ply, etc. to achieve the desired end fabric. It should also be noted in the fabric 50 of FIGS. 2 and 3 (and the other fabric embodiments to be described below), that the decorative side of fabric 50—that is, the side whereby the warp yarns 46 and weft-insert yarns 24*a*–24*d* are visible to form the desired fabric pattern—is the technical back side of fabric 50. Therefore, by proper denier selection of warp-knitting yarns 22*a*–22*d*, the woven-like appearance of fabric 50 will be further enhanced since the warp knitting yarns 22*a*–22*d* can be substantially visibly imperceptible owning not only to their denier but also to the fact that a minimum amount of yarns 22*a*–22*d* will be exposed while the weft inserted yarns 24*a*–24*d* and interpositioned warp yarns 46 on the technical back side of fabric 50 are exposed to a maximum extent.

Any suitable fabric may be utilized for substate 34. Preferably, substrate 34 is a 100% polyester nonwoven fabric having a weight of about 0.65 ounces/yard.

It should be understood that many variations can be achieved on accordance with the present invention. Accordingly, while the guide bars 18*a*–18*d* are shown in accomponying FIG. 1 as cooperating with stitch needle 16 so as to form a stitch wale with a combination of stitch yarns 22*a*–22*d*, only one of the stitch yarns 22*a*–22*d* need be provided for such purpose in which case the others of guide bars 18*a*–18*d* are either unused or are used to lay in e.g. a decorative warp yarn as will be explained with reference to FIGS. 4 and 5.

As can be seen in FIG. 4 the fabric 60 (similar to fabric 50 discussed above with reference to FIGS. 2 and 3) includes the substrate 34 and stitch loops forming a chain stitch wale 52*a* (only one stitch wale being shown in FIG. 4 for clarity of presentation). Weft insert yarns 24*a*–24*d* are thus inserted in a similar manner within stitch courses of stitch wale 52a, while warp yarn 46 is interposed between the inserted weft yarns 24*a*–24*d* and substrate 34. One of the guide bars 18*a*–18*d* (See FIG. 1), however, is utilized to guide a decorative yarn 62 so that it is laid in over the weft yarns 24*a*–24*d* and is also captured within the formed chain stitches of stitch wale 52*a* during formation thereof at knitting area 12.

FIG. 5 shows a further variation on the use of the present invention together with decorative yarns 62, 64. The fabric 70 is similar to the fabric 60 discussed above with the principal exception being that portions 62*a*, 64*a* of the decorative yarns 62, 64, respectively, are extended generally in the weft-wise direction between adjacent stitch wales 52*a*, 52*b* so as to be captured within chain stitches formed therein. In addition, another one of guide bars 18*a*–18*d* is utilized so as to guide additional decorative yarns 66 which are laid in over the weft-inserted yarns 24*a*–24*d* but under the decorative yarns 62 and 64, the latter yarns holding the former yarns into the fabric 70 by means of the weft-wise extended portions 62*a*, 64*a*.

As can be appreciated, the present invention is certainly not limited to the exemplary fabric designs shown in the accompanying figures nor is it limited to the use of chain stiches. For example, the warp knitting yarns 22*a*–22*d* (the stitch underlap 55) can themselves be formed in a decorative pattern as shown in FIG. 6 to further enhance the aesthetic appearance of the resulting fabric 80 thereof. The stitch technique employed in FIG. 6 can be better understood by reference to commonly-owned and copending U.S. application Ser. No. 661,072 filed Oct. 15, 1984, the entire disclosure thereof being expressly incorporated hereinto.

When utilizing the warp knit yarns to form a plurality of stitch wales, it is preferred that more than one yarn 46 be positioned between adjacent stitch wales as is shown in FIG. 2. Such a usage of the interposed warp yarns 46 increases the "fill" in the warp-wise direction thereby rendering the interposed warp yarns 46 the predominant color field for the resulting fabric.

Any suitable yarn can be employed in the practice of this invention including natural and/or synthetic filament yarns which may be textured, spun and/or novelty type yarns to give the fabric the desired finished appearance and/or color. Various sizes of the respective yarns employed as the warp knitting yarns 22*a*–22*d*, weft insert yarns 24*a*–24*d* and interposed warp yarns 46 can also be utilized, the exact size of the yarns being chosen to provide not only the desired appearance of the finished fabric but also to be within the tolerances of the particular warp-knitting, weft-insertion machine modified in accordance with the present invention. By way of example only, the stitch yarns 22*a*–22*d* may be 40–150 denier textured polyester yarns while the inserted weft yarns 24*a*–24*d* and decorative yarns 62, 64 could be about 300 denier rayon, acrylic or polyester spun yarns. The warp yarns 46 are preferably a 150 denier natural or slasher-dyed yarn of textured polyester.

Accordingly, while the present invention has been herein described in what is presently conceived to be the most preferred and exemplary embodiments thereof, those in this art may recognize that many modifications may be made, which modifications shall be accorded the broadest scope of the appended claims so as to encompass all equivalent fabrics, methods and apparatus.

What is claimed is:

1. A warp knit fabric comprising a substrate, plural warp yarns laid on a face of said substrate, plural weft yarns laid over said warp yarns and perpendicular to the warp direction, and plural stitch wales spaced-apart along the warp-wise direction of said fabric and being stitched through said substrate to hold said weft and warp yarns in position on said substrate; the stitch loops of the stitch wales disposed on one side of said substrate, and the stitch underlap disposed over said warp and weft yarns.

2. A warp knit fabric as in claim 1 wherein said warp yarns are positioned between respective adjacent pairs of said stitch wales.

3. A warp knit fabric as in claim 2 wherein more than one of said warp yarns are positioned between said respective adjacent pairs of said stitch wales

4. A warp knit fabric as in claim 1 wherein said stitch wales are formed of a plurality of chain stitches.

5. A warp knit fabric as in claim 1 further comprising a set of decorative warp yarns laid over said weft yarns and having portions captured within respective formed stitches of at least one of said stitch wales.

6. A warp knit fabric as in claim 5 wherein said portions extend in a generally weft-wise direction and are captured in respective formed stitches of a stitch wale adjacent to said at least one stitch wale.

7. A warp knit fabric as in claim 6 further comprising a second set of decorative warp yarns laid over said weft yarns but under said weft-wise extended portions of said first-mentioned decorative warp yarns whereby said weft-wise extended portions hold said second warp yarns in said fabric.

8. A warp knit fabric as in claim 1 further comprising a coating layer applied to a second face of said substrate, opposite to said first-mentioned face.

9. A warp knit fabric as in claim 8 wherein said first-mentioned face is a technical back side of said fabric and wherein said second face is a technical front side of said fabric.

10. A warp knit fabric as in claim 1 or 2 wherein said substrate is a non-woven fabric.

11. A warp-knit, weft-inserted fabric having a non-woven substrate, plural stitch wales running in the warp-wise direction and stitched through said non-woven substrate so as to form stitch courses on a technical back side of said non-woven substrate, parallel weft yarns inserted into predetermined ones of said formed stitch courses of said stitch wales, and warp yarns interposed between said technical back side of said non-woven substrate and said weft yarns and positioned in the warp-wise direction between respective adjacent pairs of said stitch wales, wherein said stitch wales hold said weft yarns onto said technical back side of said non-woven substrate by virtue of their insertion into said formed stitch courses, said inserted weft yarns thereby holding said warp yarns onto said technical back side of said non-woven substrate by virtue of the interpositioning of said warp yarns between said weft yarns and said technical back side; the stitch loops of the stitch wales disposed on one side of said substrate, and the stitch underlap disposed over said warp and weft yarns.

* * * * *

UNITED STATES PATENT AND TRADEMARK OFFICE

CERTIFICATE OF CORRECTION

PATENT NO. : 4,682,480

DATED : July 28, 1987

INVENTOR(S) : Julius Schnegg and Vaclav Petracek

It is certified that error appears in the above-identified patent and that said Letters Patent is hereby corrected as shown below:

In the Cover Sheet, left hand column, under the heading "Inventor:" a coinventor should be added as follows: Vaclav Petracek, Bayside, N.Y. In the Abstract, third line from the bottom, "ara" should read -- area --.

Column 4, line 7, "wrap" should read -- warp --.

Signed and Sealed this

Twenty-third Day of February, 1988

*Attest:*

DONALD J. QUIGG

*Attesting Officer*

*Commissioner of Patents and Trademarks*